US012420129B2

(12) United States Patent
Huffman et al.

(10) Patent No.: US 12,420,129 B2
(45) Date of Patent: Sep. 23, 2025

(54) PLAYGROUND CLIMBER UNIT COMPRISING ONE OR MORE NET-CONTAINING PORTIONS AND/OR ONE OR MORE SUSPENDED TUBE PORTIONS

(71) Applicant: PlayCore Wisconsin, Inc., Chattanooga, TN (US)

(72) Inventors: Jonathan Huffman, Grants Pass, OR (US); Tim Millard, Grants Pass, OR (US); Wesley Hutchinson, Selma, OR (US)

(73) Assignee: PLAYCORE WISCONSIN, INC., Chattanooga, TN (US)

( * ) Notice: Subject to any disclaimer, the term of this patent is extended or adjusted under 35 U.S.C. 154(b) by 443 days.

(21) Appl. No.: 17/727,458

(22) Filed: Apr. 22, 2022

(65) Prior Publication Data

US 2022/0241636 A1 Aug. 4, 2022

Related U.S. Application Data

(63) Continuation of application No. 16/579,361, filed on Sep. 23, 2019, now Pat. No. 11,338,163.

(Continued)

(51) Int. Cl.

| | |
|---|---|
| ***A63B 9/00*** | (2006.01) |
| ***A63B 17/02*** | (2006.01) |
| ***A63G 21/02*** | (2006.01) |

(52) U.S. Cl.

CPC ..... *A63B 9/00* (2013.01); *A63B 17/02* (2013.01); *A63B 2009/004* (2013.01); *A63B 2009/006* (2013.01); *A63G 21/02* (2013.01)

(58) Field of Classification Search

CPC ..... A63B 9/00–2009/008; A63B 17/00–04; A63B 2208/12; A63G 31/00; A63G 21/00; A63G 21/02; A63G 21/22; F16L 3/02

(Continued)

(56) References Cited

U.S. PATENT DOCUMENTS 5,205,748 A * 4/1993 Petersheim ..... A63B 9/00 434/258

5,226,864 A 7/1993 Showers (Continued)

OTHER PUBLICATIONS

Throwbacks (Tanya, "15 Pictures That Will Remind You Why You Were Obsessed with McDonald's Play Places" [online], Sep. 7, 2017 [retrieved on Jan. 27, 2020], Throwbacks, retrieved from: https://www.throwbacks.com/15-pictures-that-will-remind-you-why-you-were-obsessed-with-mcdonalds-play-places/ (Year: 2017).

(Continued)

*Primary Examiner* — Loan B Jimenez
*Assistant Examiner* — Catrina A Letterman
(74) *Attorney, Agent, or Firm* — McAndrews, Held & Malloy, Ltd.

(57) ABSTRACT

Climbing units that provide an enhanced play experience through the incorporation of any of a variety of elements including nets, suspended portions, and coupling elements, and to playground structures that contain those climbing units. In some embodiments, the climber unit may comprise one or more rigid portions and one or more net-containing portions connected end-to-end to produce a continuous climbing pathway. In other embodiments, the climber unit may comprise one or more rigid portions and one or more suspended portions connected end-to-end to produce a continuous climbing pathway. The suspended portion may be attached to adjacent rigid portions by flexible couplers, such that the suspended portion will move when a child climbs (Continued)

through it. In other embodiments, the climber unit may be mounted to an elevated playground structure such that there are no footers connecting the climber unit to the ground.

21 Claims, 16 Drawing Sheets

Related U.S. Application Data

(60) Provisional application No. 62/734,618, filed on Sep. 21, 2018.

(58) Field of Classification Search
USPC ..... 248/72, 227.3
See application file for complete search history.

(56) References Cited

U.S. PATENT DOCUMENTS 5,669,855 A * 9/1997 Dunn, Jr. ..... A63B 9/00 482/35
5,690,584 A * 11/1997 Strawcutter ..... A63B 9/00 482/35
5,692,993 A * 12/1997 Dunn, Jr. ..... A63B 9/00 482/35
5,695,407 A * 12/1997 Dunn, Jr. ..... A63B 19/04 472/95
5,735,748 A * 4/1998 Meyers ..... A63G 21/18 472/117
7,815,513 B2 * 10/2010 Rieber ..... A63G 21/10 472/117
8,382,602 B2 2/2013 Rieber
2011/0244973 A1 * 10/2011 Brown ..... A63G 31/00 446/397
2015/0119199 A1 * 4/2015 Keller ..... A63B 9/00 29/525.08
2015/0133229 A1 * 5/2015 Weston ..... A63G 21/18 472/117

OTHER PUBLICATIONS

Pucuda Leading Edge Document (derived from: Pucuda Leading Edge, Nov. 4, 2016 [retrieved on Jan. 27, 2020], retrieved from: https://netting.com/climbing-cargo-tube-bridgel) (Year: 2016).

* cited by examiner

PLAYGROUND CLIMBER UNIT COMPRISING ONE OR MORE NET-CONTAINING PORTIONS AND/OR ONE OR MORE SUSPENDED TUBE PORTIONS

The present application is a continuation of U.S. Non-provisional application Ser. No. 16/579,361, filed on Sep. 23, 2019, which claims priority to U.S. Provisional Application No. 62/734,618, filed on Sep. 21, 2018, the entireties of which are incorporated by reference herein.

BACKGROUND OF THE INVENTION

Many playgrounds include elevated play structures as a central attraction. These elevated play structures provide children with various opportunities to climb to one or more heights and then slide down using one or more slides. Inevitably, children attempt to climb up the one or more slides to access the elevated play structures, which can lead to congestion and, in some cases, potentially dangerous situations. The present invention provides climbing units that are easily distinguished from slides and that offer a variety of enjoyable climbing experiences.

SUMMARY OF THE INVENTION

The present disclosure is directed to climbing units and other playground units (e.g. slides and the like) that provide an enhanced play experience, such as through the incorporation of one or more of a variety of different novel climbing elements (e.g. net-containing portions, suspended portions, etc.) and/or through a novel mounting assembly that reduces or eliminates obstructions on the play surface in the vicinity of the unit, and to playground structures that contain one or more of those climbing units.

In some embodiments, the climber unit may comprise one or more rigid portions and one or more net-containing portions connected end-to-end to produce a continuous climbing pathway. The rigid portion may comprise a tubular element having a central opening through which a child climbs. The net-containing portion may include a plurality of cords arranged to form a net over which a child climbs.

In some embodiments, the net-containing portion may also include a structure providing the child with at least a partial enclosure. This structure may be rigid, e.g. support bars, or flexible, e.g. protective netting. The combination of the net and the protective structure may define a central opening through which a child climbs (e.g. one that corresponds with that of a connected tubular portion). In other embodiments, the net-containing portion may not include any additional protective structure (for instance, where the climber unit is mounted close to the ground or play surface).

In some embodiments, the net-containing portion may be connected directly to flanges of the rigid tubular portions. For instance, the net may have first and second ends, each of which is secured to a flange of an adjacent tube portion. Similarly, the structure providing at least a partial enclosure may have first and second ends, each of which is also secured to a flange of an adjacent tube portion. In other embodiments, the net-containing portion may itself comprise a flange, which may be secured to a flange of an adjacent tube portion. In either case, one or more of the flanges may also include an additional element, such as a retaining ring or reinforcing plate, that provides additional structural support.

In some embodiments, the climber unit may comprise one or more rigid portions and one or more suspended portions connected end-to-end to produce a continuous climbing pathway. The rigid portion may comprise a tubular element having a central opening through which a child climbs. The suspended portion may also comprise a tubular element having a central opening through which a child climbs. The suspended element may be attached to adjacent rigid portions by flexible couplers, such as a coupler comprising a plurality of flexible cords. Due to the flexible coupling with adjacent rigid portions, the suspended portion (which may itself be made of a rigid material) will move when a child climbs on or through it. Some embodiments of the climber unit may include more than one suspended portions adjacent to one another. In those embodiments, the adjacent suspended portions may be joined by a single flexible coupler for example.

In some embodiments, the climber unit may be suspended from an elevated playground structure through the use of one or more coupling units, each of which is configured to mount an elevated section of the climber unit to a support post of the playground structure. These coupling units, which may include overhead trusses and/or underside coupling units, remove the need for footers connecting the elevated sections of the unit to the play surface. By removing footers connecting the climber unit to the play surface, one may provide a playground having an improved play space with fewer obstacles to free play. Indeed, the coupling units described herein are not limited to use on the enhanced climber units described herein. Instead, the overhead truss aspect of the present disclosure may be used to mount any number of play devices, including conventional climber units, slides, and the like, from an elevated play structure to achieve the same benefits.

Embodiments of the climber units may be attached to an elevated playground structure in a number of ways. For instance, a first end of the climber unit may be attached to an elevated playground structure and a second end of the climber unit may be freestanding. Optionally, the freestanding end may be accessed by way of a net positioned between the freestanding end and the play surface. Alternatively, both ends of the climber unit may be attached to an elevated playground structure, such as at different elevations.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Embodiments of the present disclosure are directed to a playground climber unit 10 and elevated playground structures 100 comprising one or more of those climber units. In some embodiments, the climber unit 10 may comprise one or more tube portions and one or more net-containing portions linked together to form a continuous pathway through which a child may climb. In some embodiments, the climber unit 10 may comprise, either independently or in addition to one or more net-containing portions, one or more suspended tube portions (in addition to one or more fixed tube portions) through which a child may climb. And in some embodiments, one or more footers for the climber unit 10 may be replaced by one or more overhead trusses extending from the associated elevated playground structure, which support at least part of the weight of the climber unit.

Figure 1:
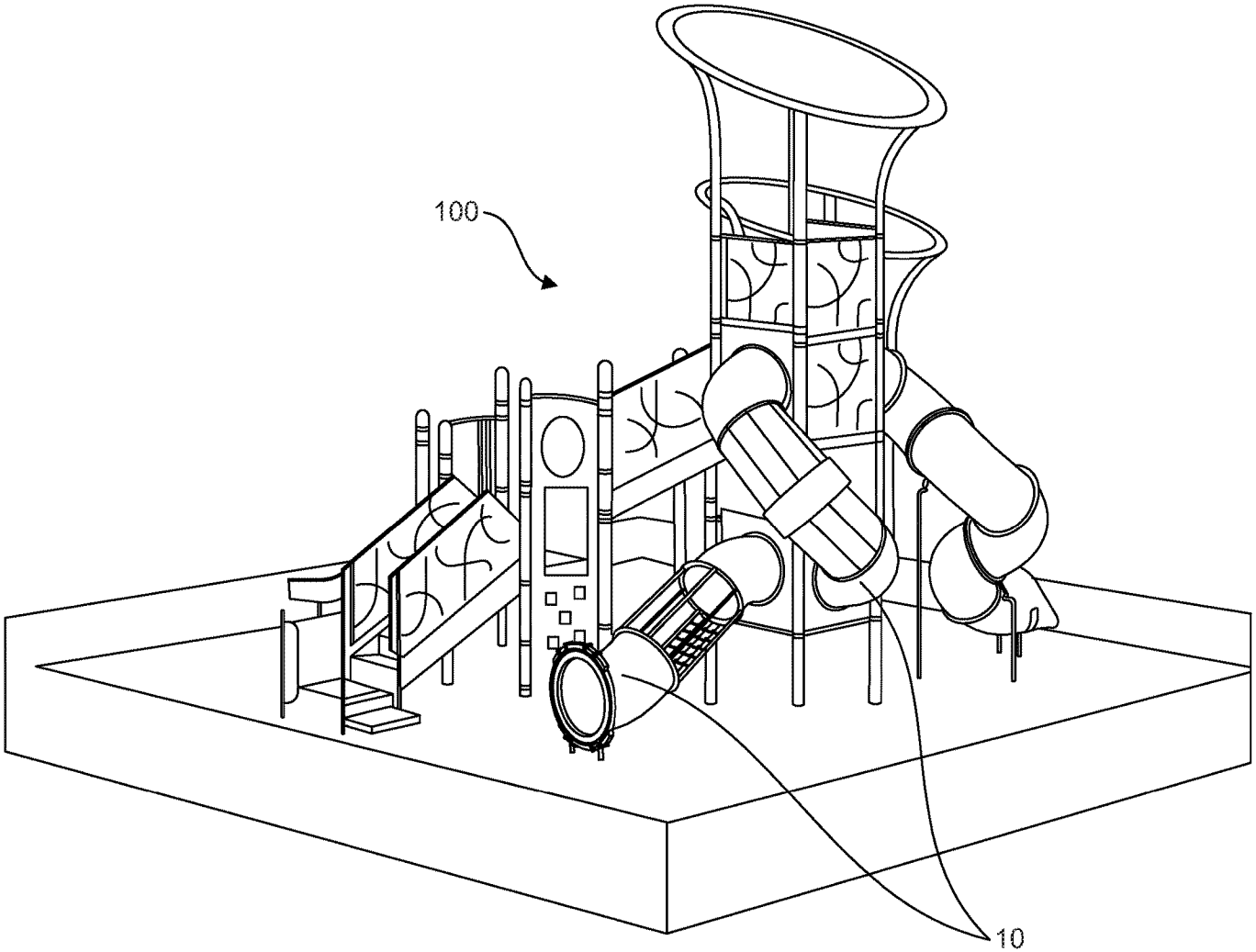
FIG. 1 is a perspective view of an elevated playground structure comprising climber units according to embodiments of the present disclosure.

An embodiment of an elevated play structure 100 comprising multiple climber units 10 according to embodiments of the present disclosure is shown in FIG. 1.

Figure 2:
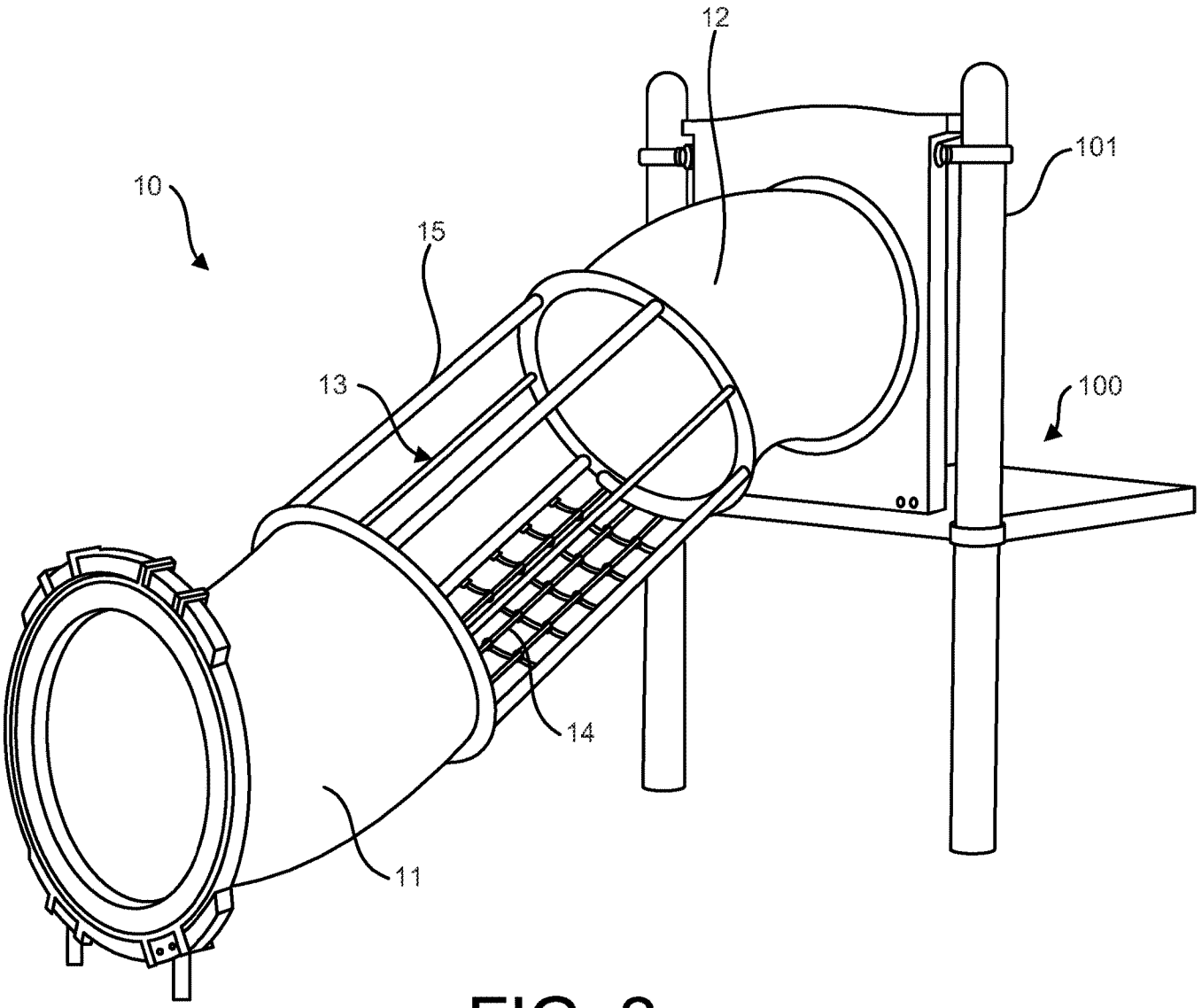
FIG. 2 is a perspective view of a climber unit according to an embodiment of the present disclosure.
Figure 3:
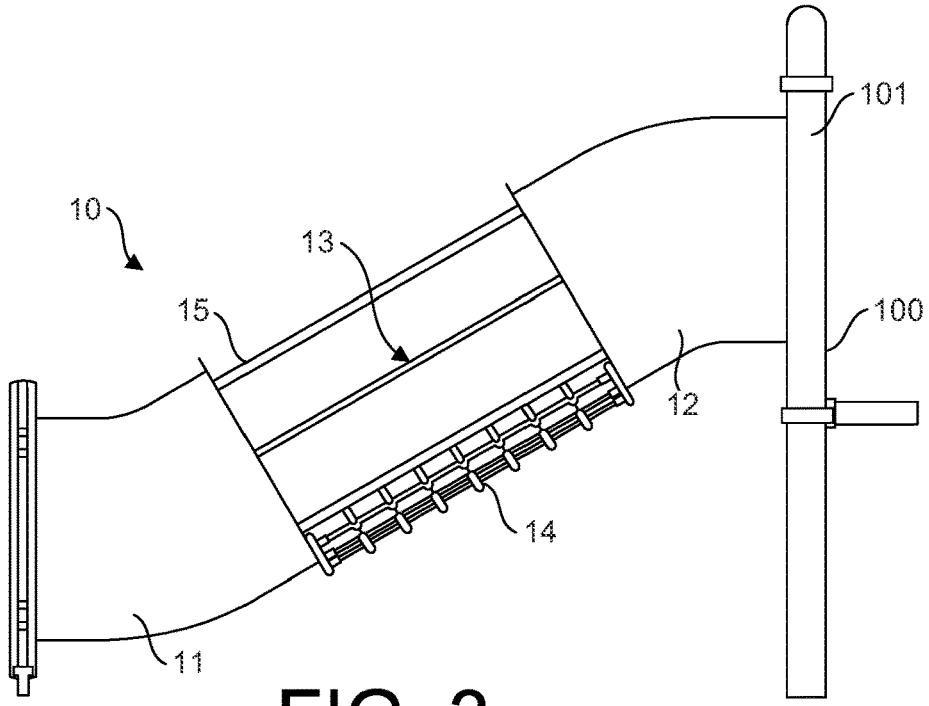
FIG. 3 is a side elevation view of the climber unit of FIG. 2.
Figure 4:
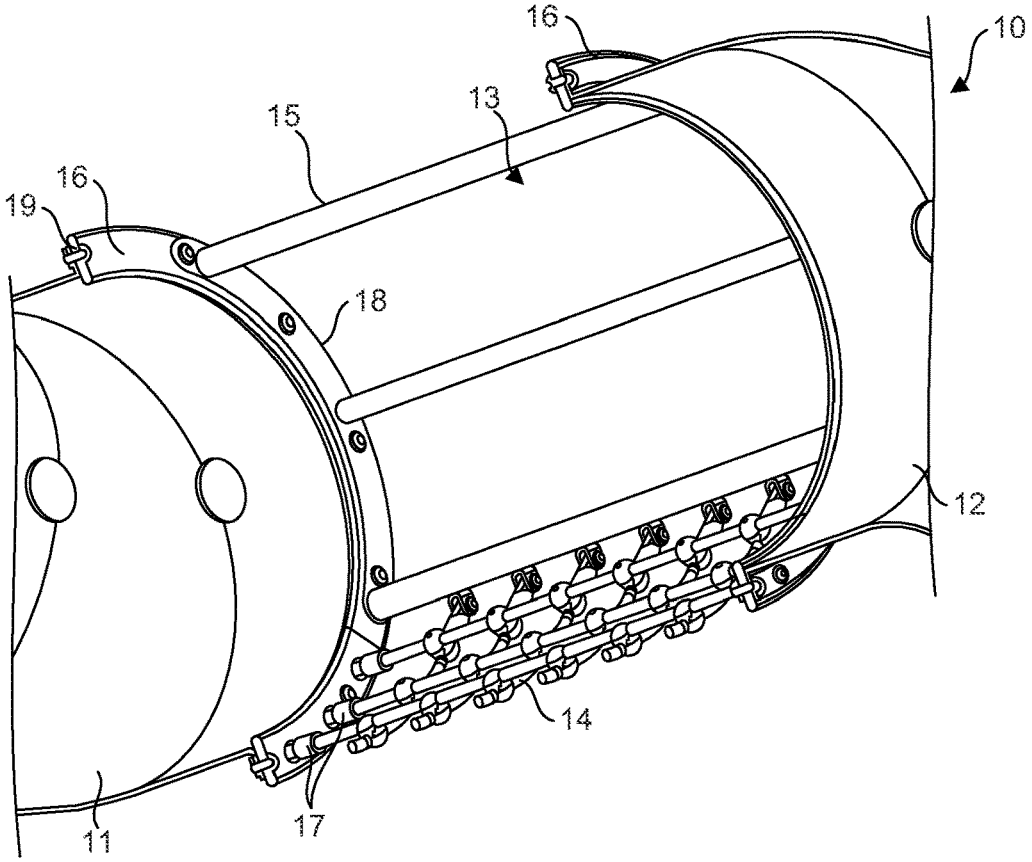
FIG. 4 is a perspective view of the climber unit of FIG. 2 showing an embodiment of the connection between a net-containing portion and a tube portion.

An embodiment of a climber unit 10 in accordance with the present description is shown in FIGS. 2 to 4. This embodiment is shown extending from a play surface, e.g. the ground, at a first end to an elevated play structure at a second end. Alternatively, however, the embodiment shown in FIGS. 2-4 could extend from one level of an elevated play structure to another level of an elevated play structure, from one play structure to another, etc. The climber unit 10 comprises a first tube portion 11 and a second tube portion 12. The climber unit 10 also comprises a net-containing portion 13. In the illustrated embodiment, the net-containing portion 13 is located between the first and second tube portions 11, 12. In other embodiments, however, the net-containing portion 13 may be located adjacent to the first end or adjacent to the second end (in which case, the climber unit 10 may only comprise a single tube portion).

Each tube portion 11, 12 comprises a wall that defines a central aperture through which a child may climb. In the illustrated embodiment, the central apertures of the tube portions are fully enclosed. In other embodiments, however, the central apertures of one or more of the tube portions may be substantially fully enclosed. For instance, the wall(s) of one or more of the tube portions may comprise one or more openings through which the central aperture may be visible. In other words, the wall(s) of the tube portions may comprise windows to the central aperture. In some embodiments, these windows may be circular. In yet other embodiments, the central apertures of one or more of the tube portions may be only partially enclosed. For instance, the upper section of the wall of one or more of the tube portions may be removed altogether or replaced with other partial enclosure elements.

Although the tube portions of the illustrated embodiment are shown as having a circular cross-section, it is also contemplated that one or more of the tube portions may have a different cross-section without departing from the scope of the present disclosure.

In some embodiments, a lower section of the inner surface of one or more of the tube portion may comprise any of a variety of grip-enhancing elements that may assist a child in climbing through the tube section. For instance, in some embodiments, the lower section of the inner surface of a tube portion may comprise a plurality of rubber pads, mats, or tiles. These grip-enhancing elements may be applied to the inner surface of the tube portion in any number of ways. For instance, the grip-enhancing element(s) may be attached to the wall with an adhesive or they may be fastened to the tube portion by one or more threaded fasteners extending through one or more small holes in the bottom of the wall.

Additionally, in some embodiments, the inner surface of one or more of the tube sections may comprise any of a variety of elevation-increasing elements, e.g. step-ups, etc., and/or handles which may also assist a child in traversing the tube portion.

Rather than an inner wall for a child to crawl on, the net-containing portion 13 comprises a plurality of cords arranged to form a net 14 that a child may climb. The term cords, as used in the present application, should be understood broadly to include any cord-like, flexible material, including ropes, cables, and the like. In the illustrated embodiment, the net 14 is positioned as the floor of the net-containing portion 13, i.e. at the bottom section of the net-containing portion. In other embodiments, the net 14 may be also positioned up along one or both side sections of the net-containing portion, thereby providing a larger net area for climbing. In some embodiments, such as that shown in FIG. 15, a net 14 may also be positioned at the upper section of the net-containing portion 13.

In addition to the net 14, the net-containing portion 13 may also contain a protective structure providing at least a partial enclosure 15. In the illustrated embodiment, the protective structure 15 comprises a plurality of tubes or rails extending between the first and second ends of the net-containing portion. The spacing between the rails may be selected as desired, although in most embodiments the rails will be placed close enough together to prevent children from easily passing between them. In some embodiments, the rails may be replaced by cords that span between the first and second ends of the net-containing portion 13.

In other embodiments, the structure providing at least a partial enclosure 15 may comprise one or more wall portions, additional netting, or the like. For instance, in some embodiments, the protective structure 15 may comprise a wall portion similar to that present in the tube portions 11, 12. As with the tube portions 11, 12, the wall portion may comprise one or more openings configured to provide windows for visibility into (and out of) the central aperture. In other embodiments, the protective structure 15 may comprise additional netting, which may be different from net 14 (e.g. in the material used, in the thickness of the cords, in the spacing between cords and thus the size of the openings, etc.) or identical/substantially identical to net 14.

As shown in FIG. 2, the net 14 and the structure providing at least a partial enclosure 15 together define a central aperture through which a child may climb. Moreover, the net-containing portion 13 and the first and second tube portions 11, 12 are joined together so that the central apertures of each portion together operate to provide a continuous pathway for a child to traverse.

The net-containing portion 13 may be connected to the first and second tube portions 11, 12 in a variety of manners. One such manner is shown in FIG. 4. In the embodiment illustrated in FIG. 4, the net 14 comprises first and second ends, each of which is directly secured to a flange 16 of an adjacent tube portion 11, 12. In the illustrated embodiment, the structure providing at least a partial enclosure 15 also comprises first and second ends, each of which is also directly secured to a flange 16 of an adjacent tube portion 11, 12.

For instance, in the illustrated embodiment, each end of the net 14 comprises a plurality of ferrules 17. Specifically, each end of the longitudinal cords of the net 14 is provided with a ferrule 17, or cap, that is configured for attachment to a flange 16 of an adjacent element (in the illustrated embodiment, the flanges of the first and second tube portions 11, 12). For example, as illustrated, the outer end of each ferrule may be configured to receive a threaded connector (e.g. it may have an internal threaded surface). Accordingly, in order to connect the net 14 to an adjacent tube portion, one need only align a ferrule 17 with a corresponding aperture in the flange 16, insert a threaded connector such as a bolt through the aperture in the flange and into the ferrule, and secure the threaded connector. In other embodiments, the outer end of each ferrule 17 may comprise a threaded connector that may be configured to extend through an aperture in the flange 16 and which may be secured by, for instance, attachment of a nut.

The protective structure 15 may be attached to the flange 16 of an adjacent structure (in the illustrated embodiment, the flanges of the first and second tube portions 11, 12) in a similar manner. Alternatively, as illustrated, protective structure 15 may comprise one or more end plates 18 that correspond to a section of the flange 16. The end plate 18 may comprise one or more apertures which may be aligned with one or more apertures in the flange 16 and secured by use of threaded connectors or the like.

It has been further recognized by the inventors that the flanges of conventional tube portions generally lack the strength necessary to support the net 14 and/or protective structure 15. Accordingly, in some embodiments, the climber unit 10 may also include one or more retaining rings 19 which are secured to the flanges 16 to provided enhanced strength. The use of such retaining rings 19 allows for existing tube slides or tube climbers to be retro-fitted with net-containing portions 13 in order to provide new and enhanced play experiences.

The retaining rings 19 generally are shaped to correspond to the flange 16 of a tube portion or a portion of the flange 16 of the tube portion. For example, in some embodiments, each retaining ring 19 may span about one-quarter of the circumference of the flange 16, meaning that four retaining rings could be attached to strengthen the entire circumference of the flange. In other embodiments, a single retaining ring 19 may span the entire circumference of the flange 16.

The one or more retaining rings 19 desirably comprise a plurality of apertures configured to align with the apertures in the flange 16 and through which threaded connectors may be passed to secure the retaining ring to the flange. Additionally, at least one of the one or more retaining rings 19 desirably comprises a plurality of apertures configured to align with the apertures in the flange 16 and through which threaded connectors may be passed to secure the net 14 to the flange. Similarly, at least one of the one or more retaining rings 19 desirably comprises a plurality of apertures configured to align with the apertures in the flange 16 and through which threaded connectors may be passed to secure the protective structure 15 to the flange.

In some embodiments, for example, a first retaining ring 19 may span a first section of the flange 16 and may comprise a plurality of apertures through which threaded fasteners are passed to secure the end of the protective structure 15 to the flange, and a second retaining ring may span a second section of the flange and may comprise a plurality of apertures through which threaded fasteners are passed to secure the end of the net 14 to the flange. In other embodiments, a single retaining ring 19 may comprise both (a) a plurality of apertures through which threaded fasteners are passed to secure the end of the protective structure 15 to the flange 16 and (b) a plurality of apertures through which threaded fasteners are passed to secure the end of the net 14 to the flange.

Although the illustrated embodiment shows the net-containing portion 13 attached at each end to a tube portion 11, 12, in other embodiments, one end of the net-containing portion may either be attached to a wall of an elevated play structure or be a free-standing entry-point to the climber unit 10. In both instances, a flange 16 similar to that of the tube portion, e.g. as illustrated in FIG. 4, may be used to attach the net 14 and protective structure 15. The flange 16 may be integral with or connected to a wall of a playground structure or it may be a stand-alone flange. In either event, the flange 16 may include a cover or cap configured to conceal the fasteners in the vicinity around the entry-point to the climber unit 10.

Figure 15:
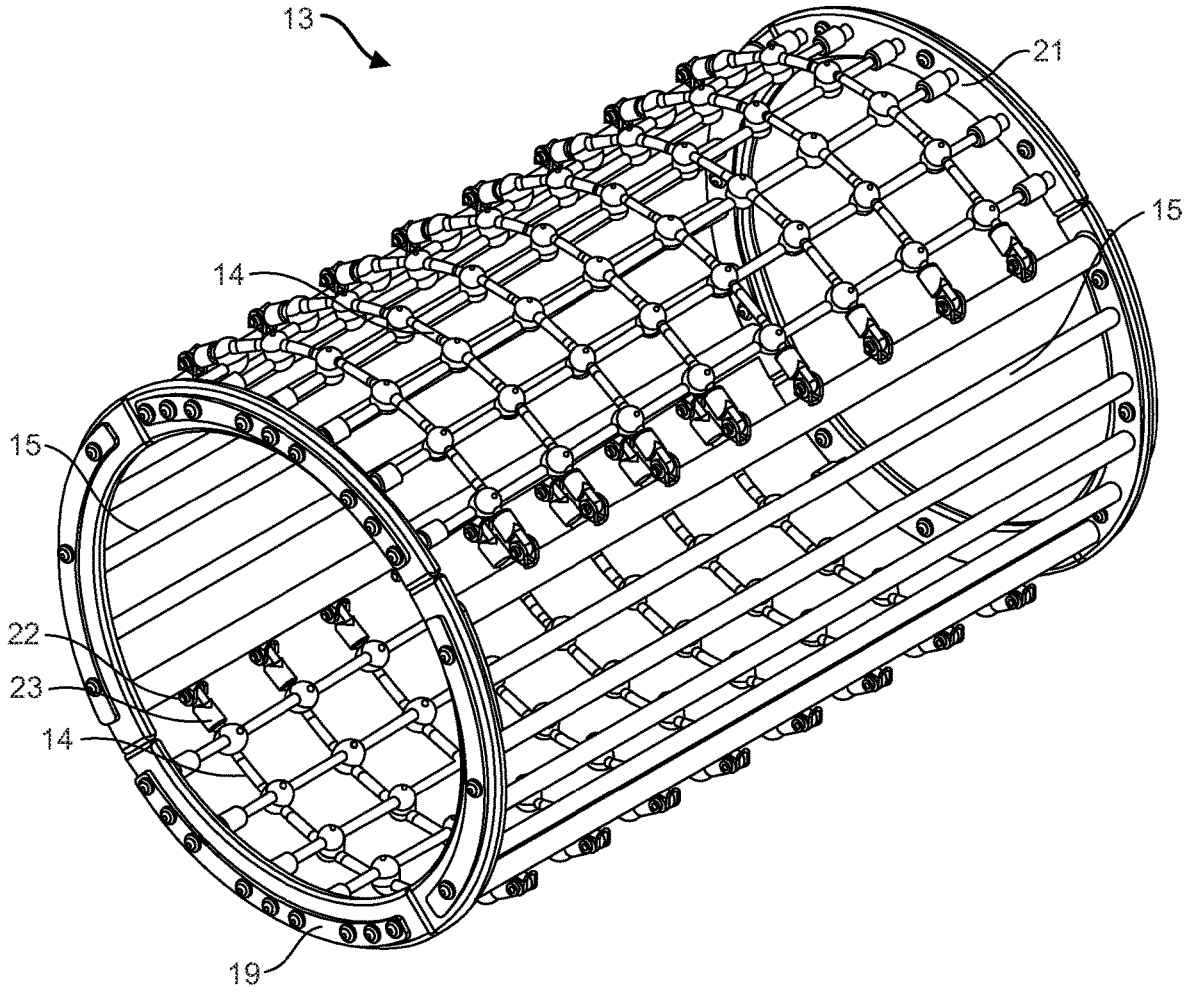
FIG. 15 is a perspective view of an embodiment of a net-containing portion for a climber unit.

In alternative embodiments, each end of the net-containing portion 13 may comprise a flange 21, such as is illustrated in FIG. 15. In these embodiments, the net 14 and the protective structure 15 may each be secured to that flange. Accordingly, in those embodiments, the net-containing portion 13 and adjacent tube-containing portions 11, 12 may be joined together by a conventional connection (e.g. bolting) between the flange 16 of the tube portion and a flange 21 of the net-containing portion. In some embodiments, one or more retaining rings 19, i.e. reinforcing plates, may be secured to one or more of the flanges. In other embodiments, however, the flanges of the net-containing portion 13 may be designed to provide sufficient reinforcement of the connected flange structure. The net 14 and protective structure 15 may be attached to the flanges 21 by any manner, including for example that described above with respect to attaching those elements to flange 16.

For enhanced stability, the net 14 may also be attached to the protective structure 15 along the length of the net-containing portion 13. In the embodiment shown in FIGS. 4 and 15, for instance, the edges of the protective structure 15 may comprise a plurality of clevises 22 and the edges of the net 14 may comprise a plurality of ferrules 23, which act as the tang to the plurality of clevises. Of course, other conventional attachment mechanisms may also be used, as would be understood by those of skill in the art.

Figure 5:
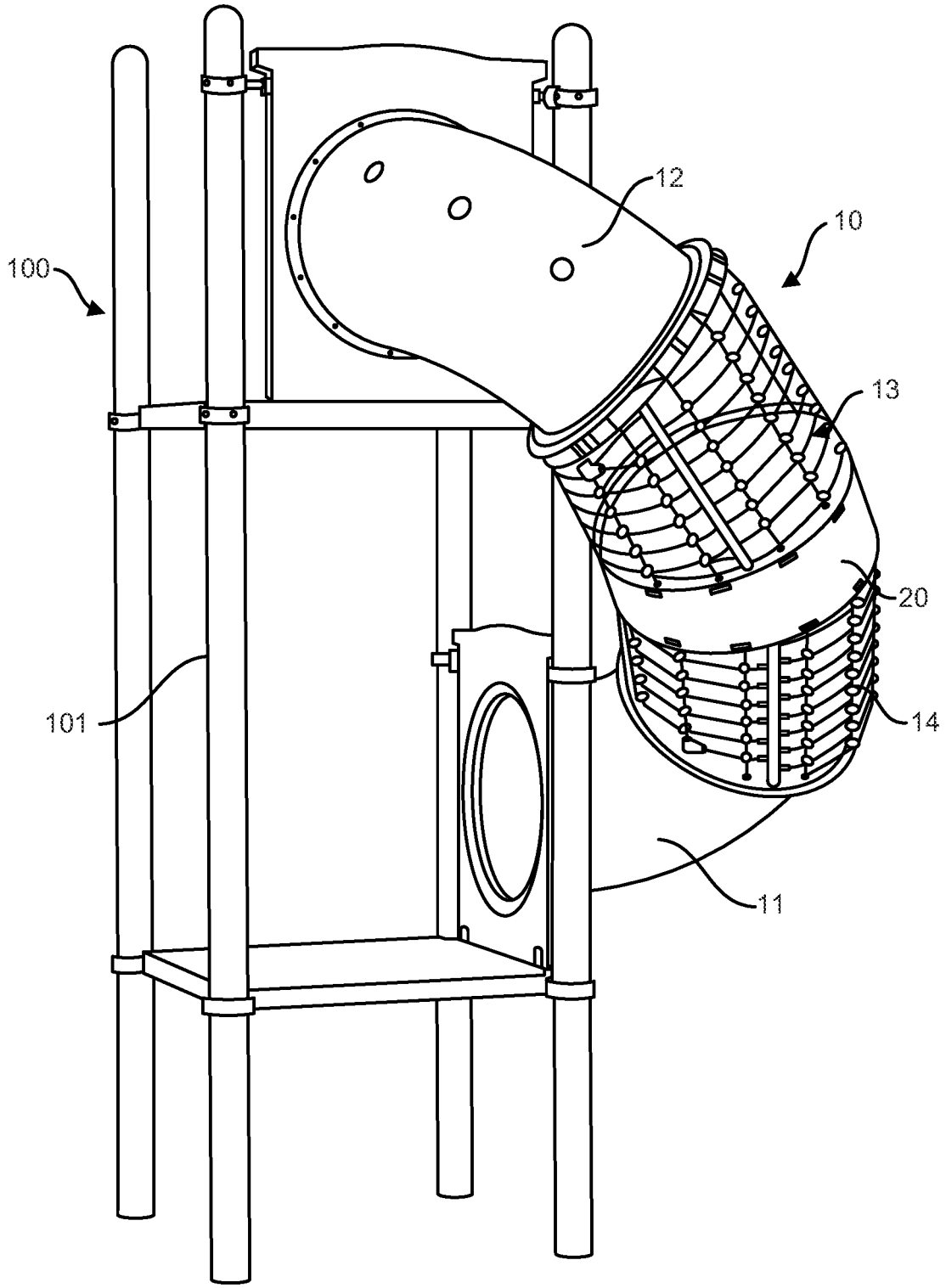
FIG. 5 is a perspective view of a climber unit according to an embodiment of the present disclosure.

Another embodiment of a climber unit 10 in accordance with the present description is shown in FIG. 5. In the embodiment illustrated in FIG. 5, the net-containing portion 13 is fully enclosed or substantially fully enclosed by net 14.

In other words, the protective structure 15 that at least partially encloses the central aperture is (or is predominantly) a continuation of net 14. Accordingly, this embodiment may be described as a "full net" embodiment. A full net enclosure may be particularly desirable where, as shown in FIG. 5, the climber 10 unit is located at a raised elevation.

The full net portion 13 may be connected to adjacent tube portions 11, 12 in the same manner as the other net-containing portions described above. Additionally, as described in the previous embodiment, although the net-containing portion 13 in FIG. 5 is shown having each end connected to a tube portion 11, 12, an end of the net-containing portion may also be connected to the elevated play structure or may represent a free-standing entry point to the climber unit 10.

In some embodiments, including for example the embodiment illustrated in FIG. 5, the net-containing portion 13 may further comprises one or more suspended wall portions 20. The suspended wall portion 20 may be useful to provide a momentary break in the net 14, as well as to provide enhanced rigidity to the net-containing portion 13 where a relatively long net 14 is used. The suspended wall portion may break the net-containing portion 13 into first and second sections. The first and second sections may contain independent first and second nets 14. Additionally, as illustrated, the suspended wall portion 20 may be connected to each adjacent tube portion 11, 12 through one or more rails or similar structures that provide the portion 13 with increased rigidity and/or strength. In other embodiments, the net-containing portion 13 need not include any suspended wall portion 20.

As shown in FIG. 5, a first end of the climber unit 10 may be attached to a first level of an elevated play structure 100 and a second end of the climber unit may be attached to a second level of an elevated play structure. In some embodiments, such as that illustrated, the second end of the climber unit 10 may even be located substantially vertically above the first end of the climber unit. For instance, a first end of the climber unit 10 may be located along a first side of an elevated structure and a second end of the climber unit may be located along a second side of the elevated structure, wherein the first side and the second side are adjacent. In other embodiments, the second end of the climber unit may be located along a second side of the elevated structure that is opposite the first side. In yet other embodiments, the second end of the climber unit may be attached to a different portion of a playground structure, e.g. a different tower, or to an independent playground structure.

Figure 6:
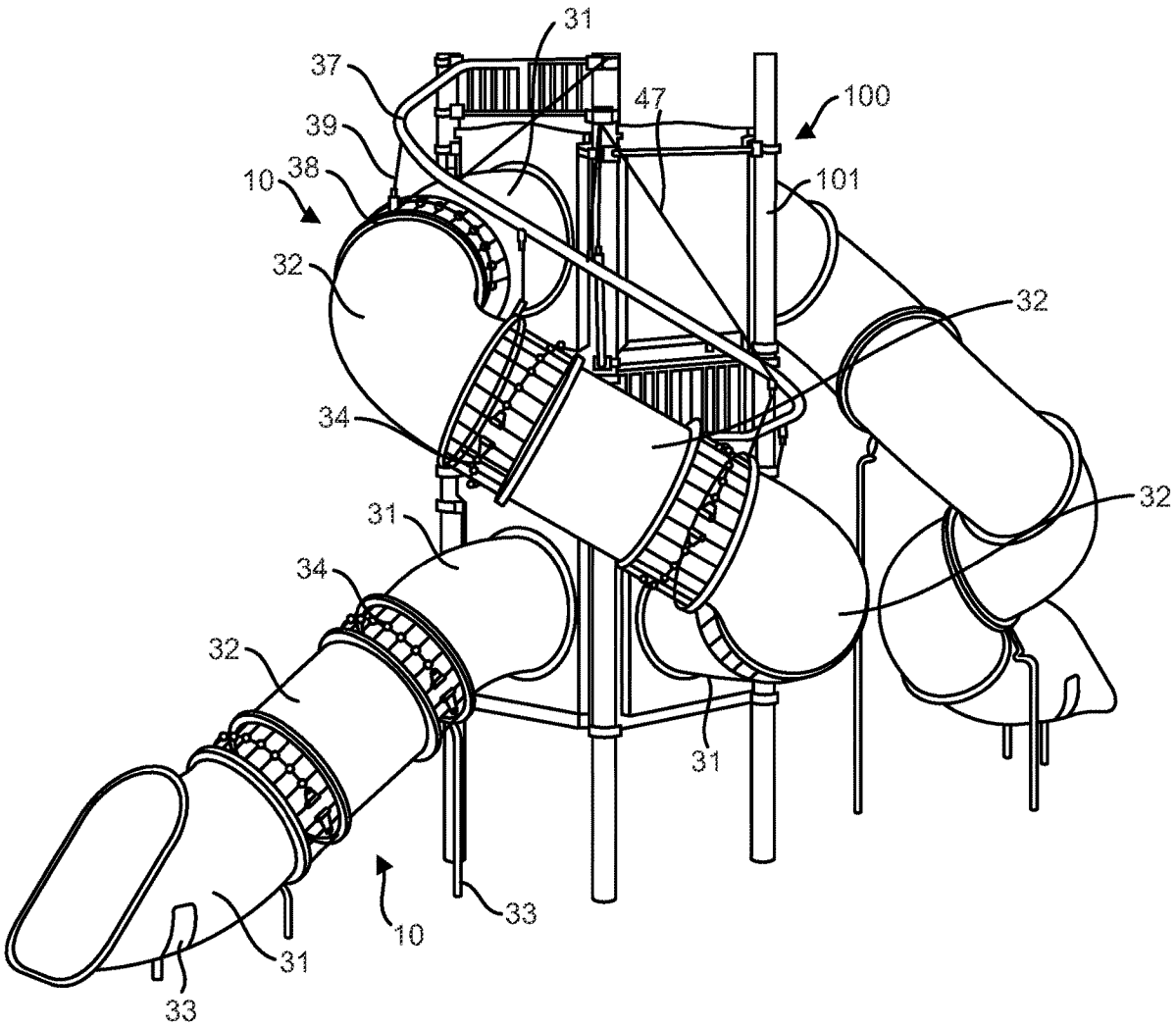
FIG. 6 is a perspective view of an elevated playground structure comprising climber units according to embodiments of the present disclosure.

Additional embodiments of climber units 10 in accordance with the present description are shown in FIG. 6. The climber units 10 shown in FIG. 6 each comprise a combination of fixed tube portions 31 and suspended tube portions 32. One or more fixed tube portions 31 and the one or more suspended tube portions 32 are joined together so that the central apertures provide a pathway for a child to traverse.

The fixed tube portions 31 each have a wall that defines a central aperture through which a child may climb. The fixed tube portions 31 may have any of the same features and elements as the tube portions described previously. The fixed tube portions 31 are locked in place due to their connection to an elevated play structure 100 and/or to the play surface, i.e. ground, such as through the illustrated footers 33.

The suspended tube portions 32, on the other hand, are able to move due to their attachment via flexible couplers 34. The suspended tube portions 32 may also have a wall that defines a central aperture through which a child may climb. Similarly, the suspended tube portions 32 may also have any of the same features and elements as the tube portions described previously. Each suspended tube portion 32 has a first end and a second end, each of which is attached to a flexible coupler 34. The flexible coupler 34 comprises a plurality of flexible cords extending in a longitudinal direction.

Figure 7:
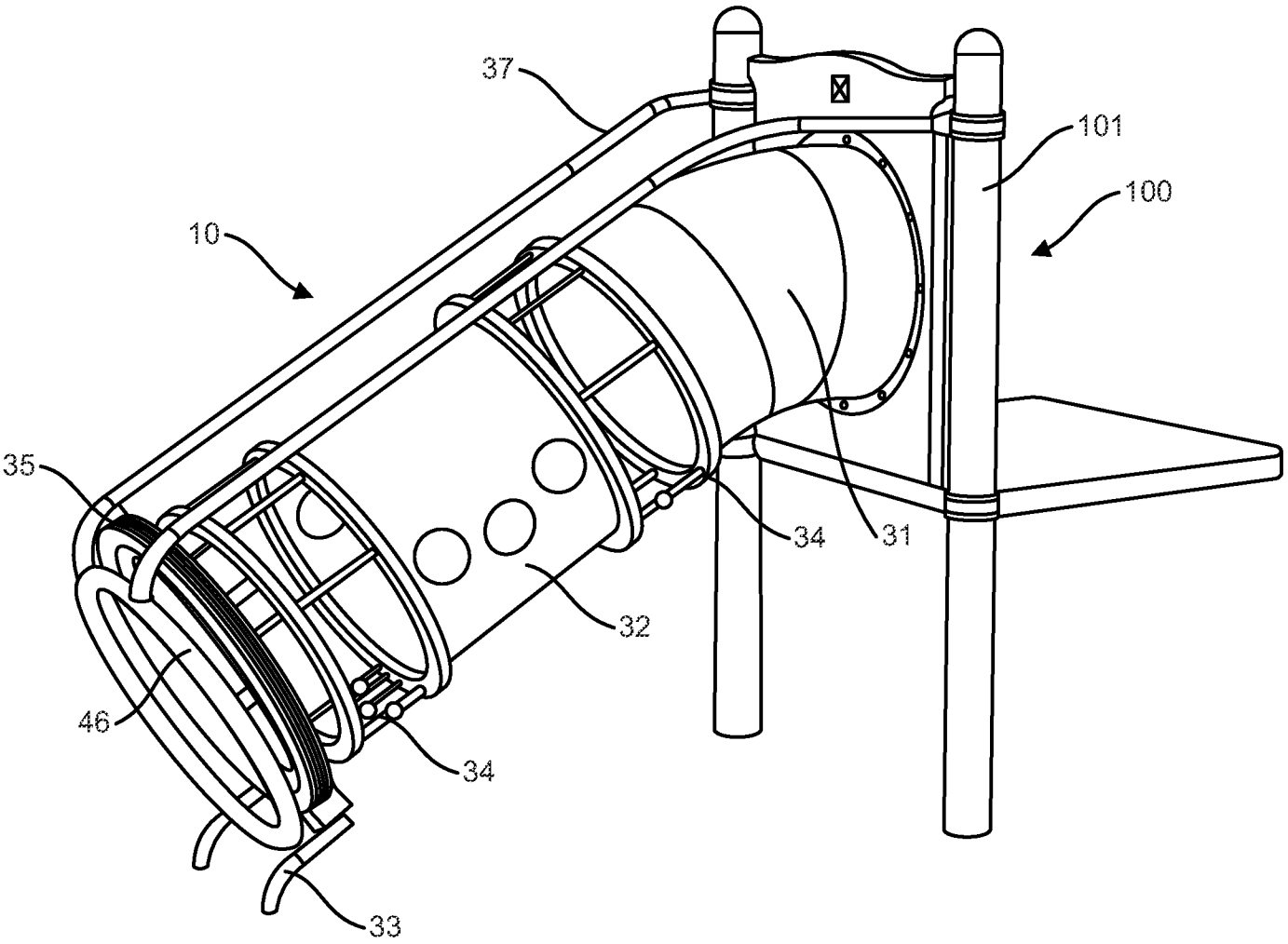
FIG. 7 is a perspective view of a climber unit according to an embodiment of the present disclosure.
Figure 8:
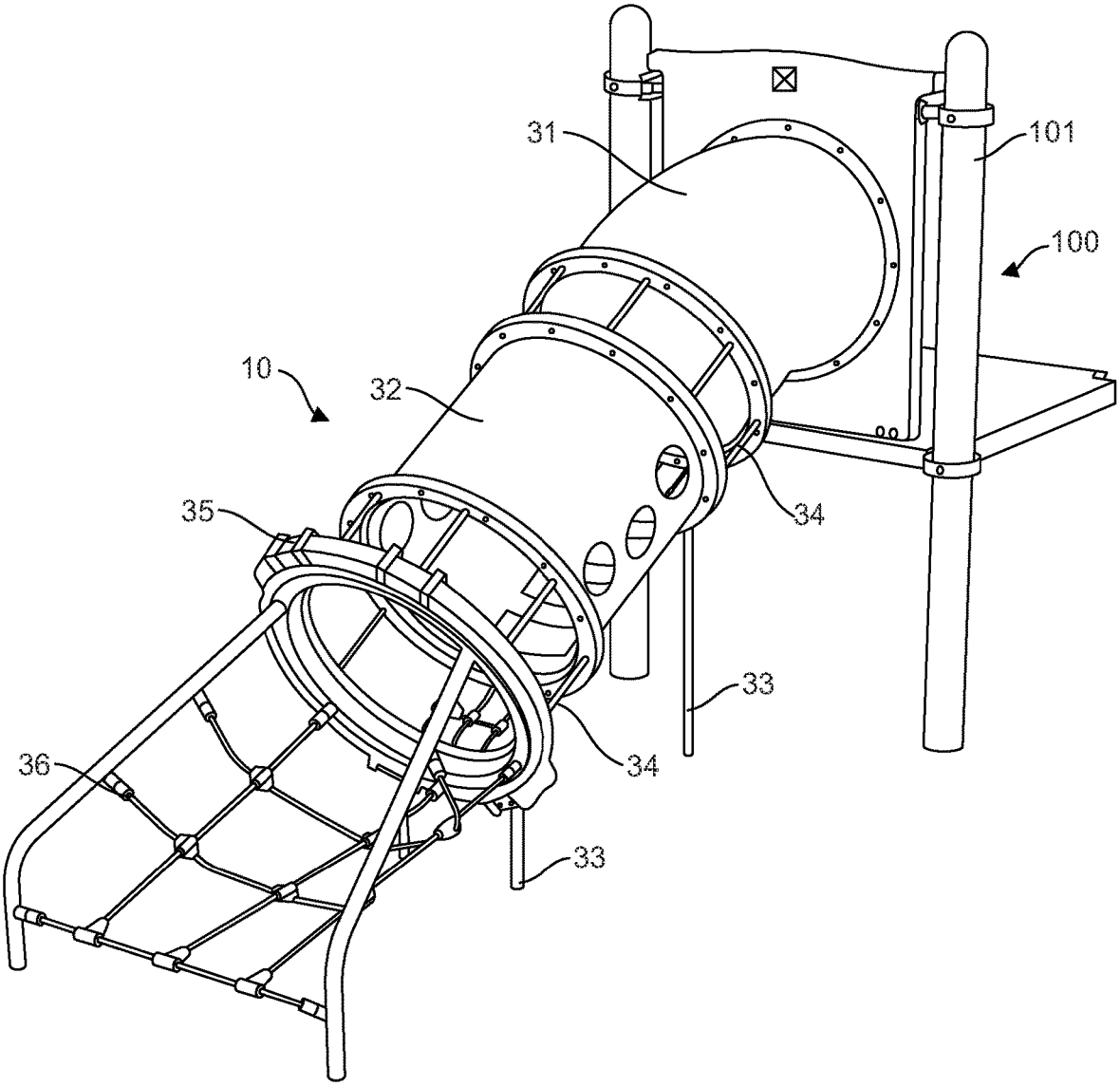
FIG. 8 is a perspective view of a climber unit according to an embodiment of the present disclosure.
Figure 9:
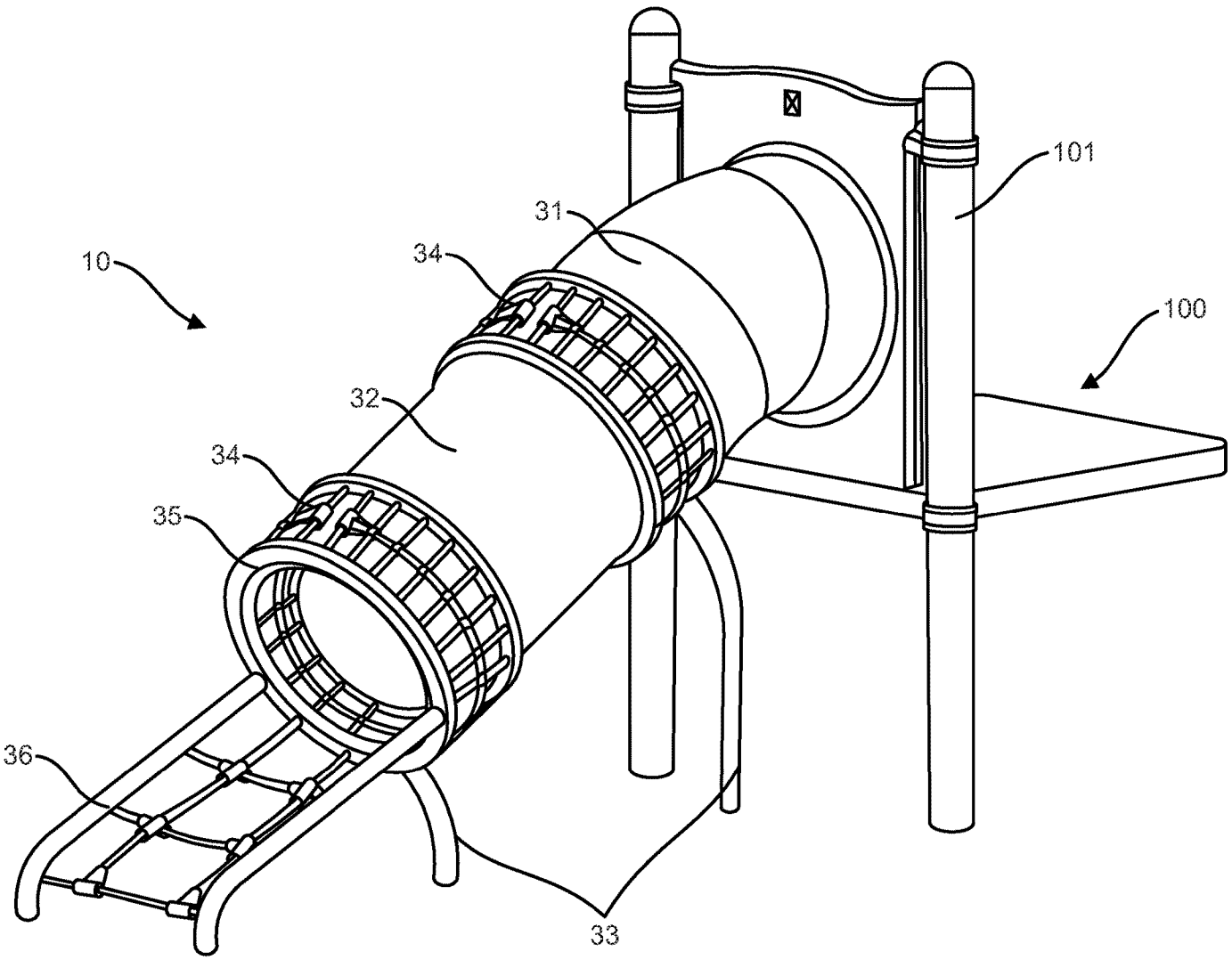
FIG. 9 is a perspective view of a climber unit according to an embodiment of the present disclosure.

Additional embodiments of climber units 10 having suspended tube portions 32 are shown in FIGS. 7-9. In the embodiment shown in FIG. 6, each suspended tube portion 32 is connected, via a flexible coupler 34, either to a fixed tube portion 31 or to an adjacent suspended tube portion 32. In the embodiments shown in FIGS. 7 to 9, however, a first end of suspended tube portion 32 is coupled to a fixed tube portion 31, but a second end of suspended tube portion is coupled to an entry flange 35. Moreover, the flexible couplers 34 shown in FIGS. 7 and 8 differ from those shown in FIGS. 6 and 9. Namely, the flexible couplers 34 shown in FIGS. 6 and 9 comprise linking cords, whereas the flexible couplers shown in FIGS. 7 and 8 comprise only (a smaller number of) cords extending in the longitudinal direction. Further, the embodiments shown in FIGS. 8 and 9 also contain a net-entry 36. Notably, the net-entry 36 can be used in combination with any of the various climber units 10 described herein, as well as other, e.g. conventional, climber units.

Figure 10A:
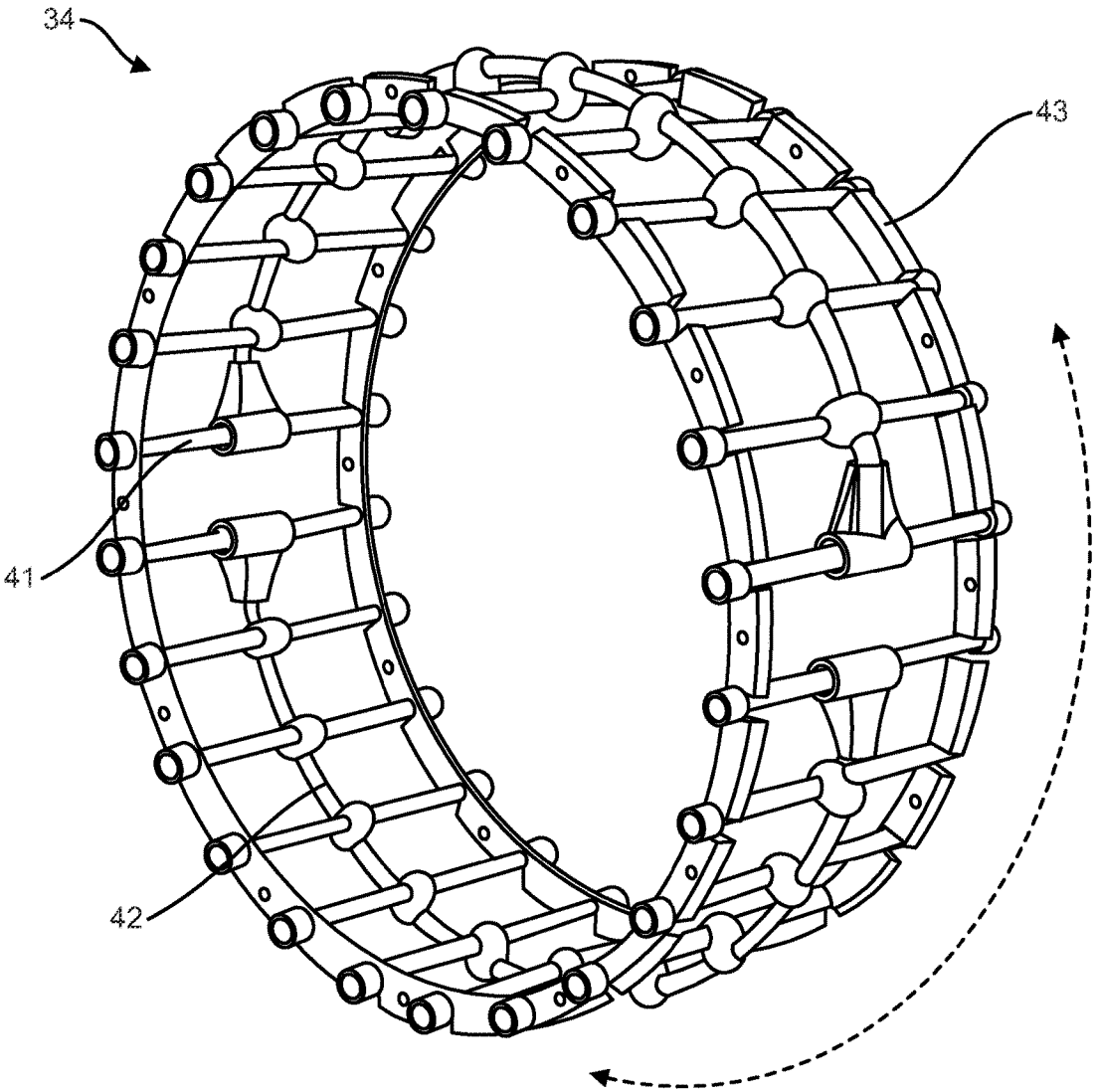
FIG. 10A is a perspective view of an embodiment of a flexible coupler according to an embodiment of the present disclosure.

An embodiment of a flexible coupler 34 is shown in FIGS. 10A (fully assembled) and 10B (showing various components in exploded view). As can be seen, the coupler 34 comprises a plurality of longitudinal cords 41 and, optionally, one or more linking cords 42. The linking cords 42 provide the flexible coupler 34 with additional stability. In other words, the inclusion linking one or more linking cords 42 will decrease the amount of movement experienced by the associated suspended tube portion 32. Accordingly, one may use linking cords 42 to give a suspended tube portion 32 a desired degree of movement or stability.

Figure 10B:
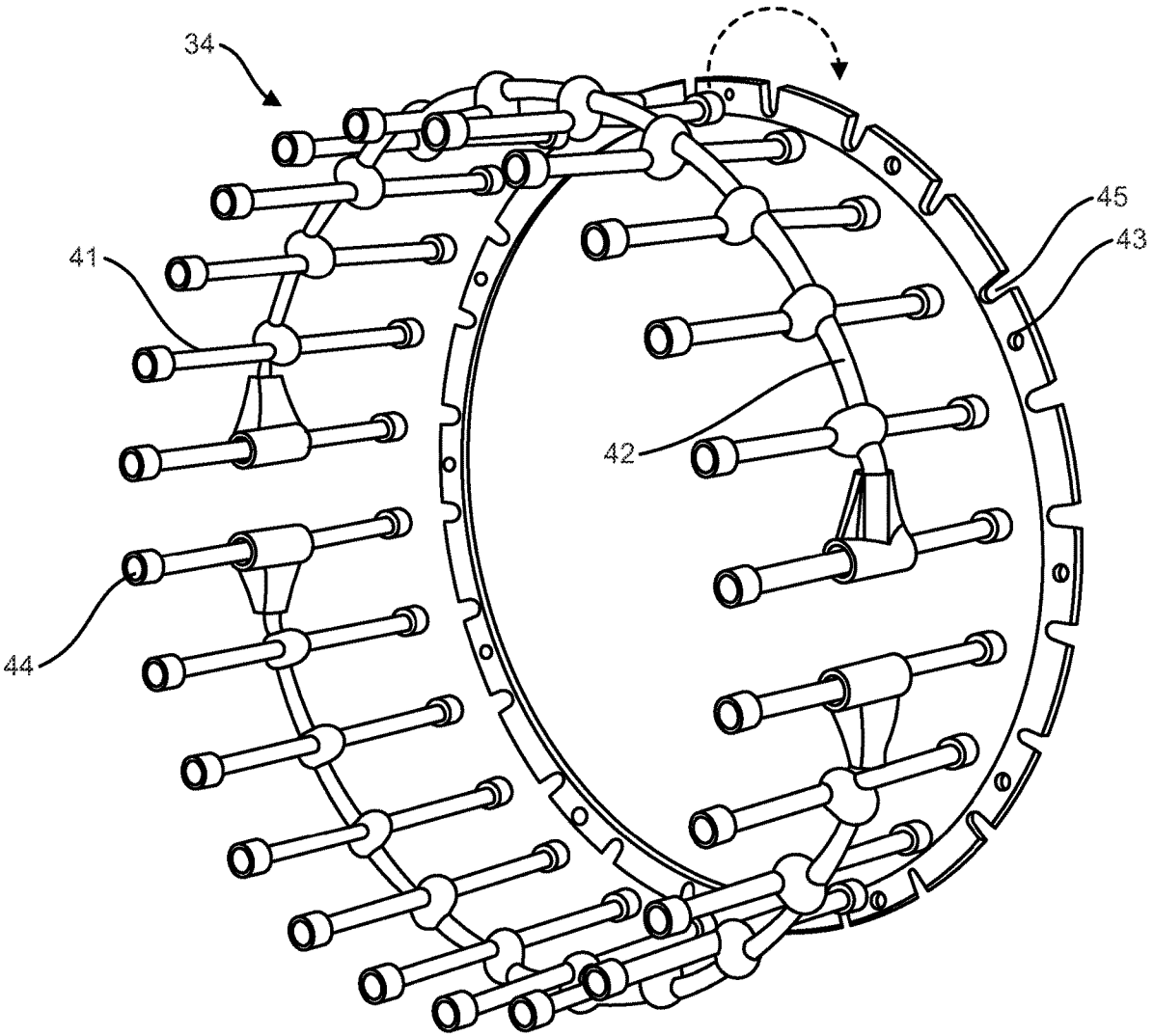
FIG. 10B is a perspective view of an embodiment of the flexible coupler of FIG. 10A, showing the components in exploded view.
Figure 11:
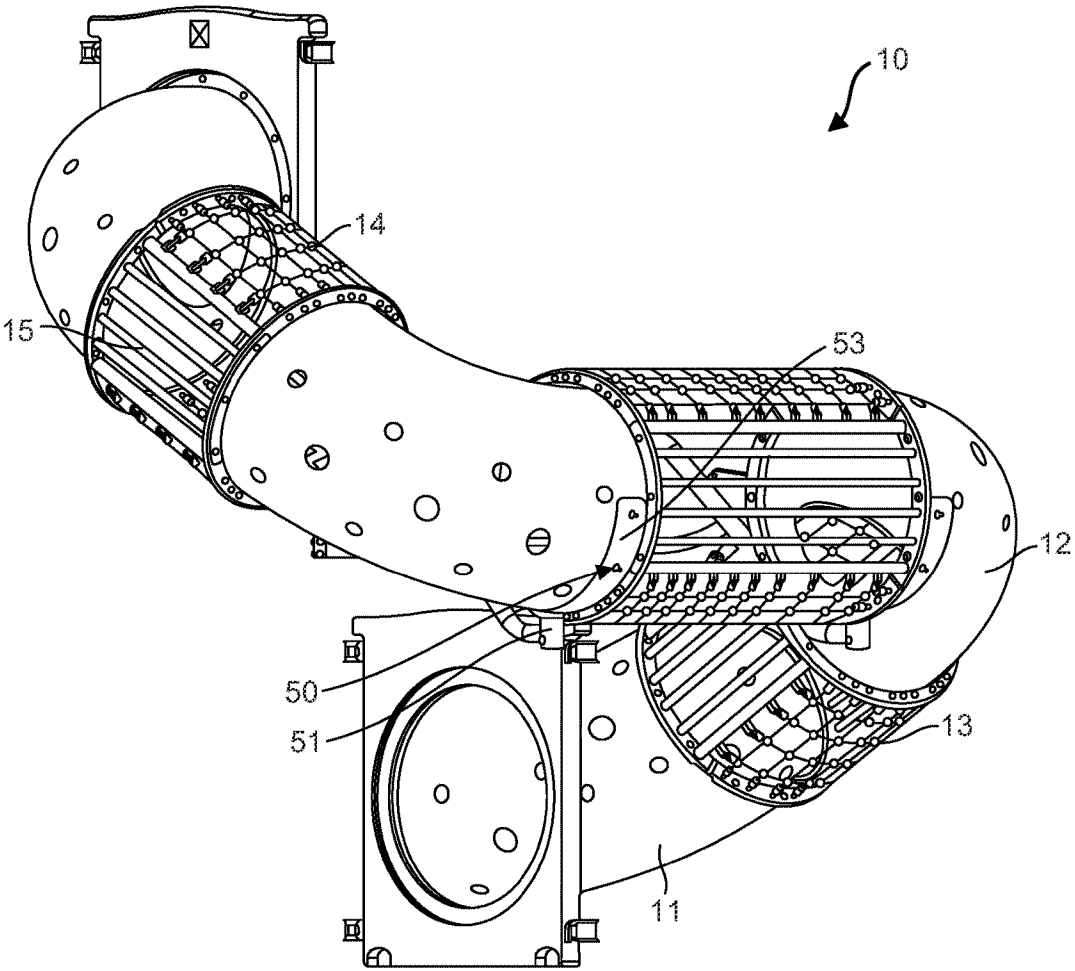
FIG. 11 is a right side perspective view of a climber unit according to an embodiment of the present disclosure.
Figure 12:
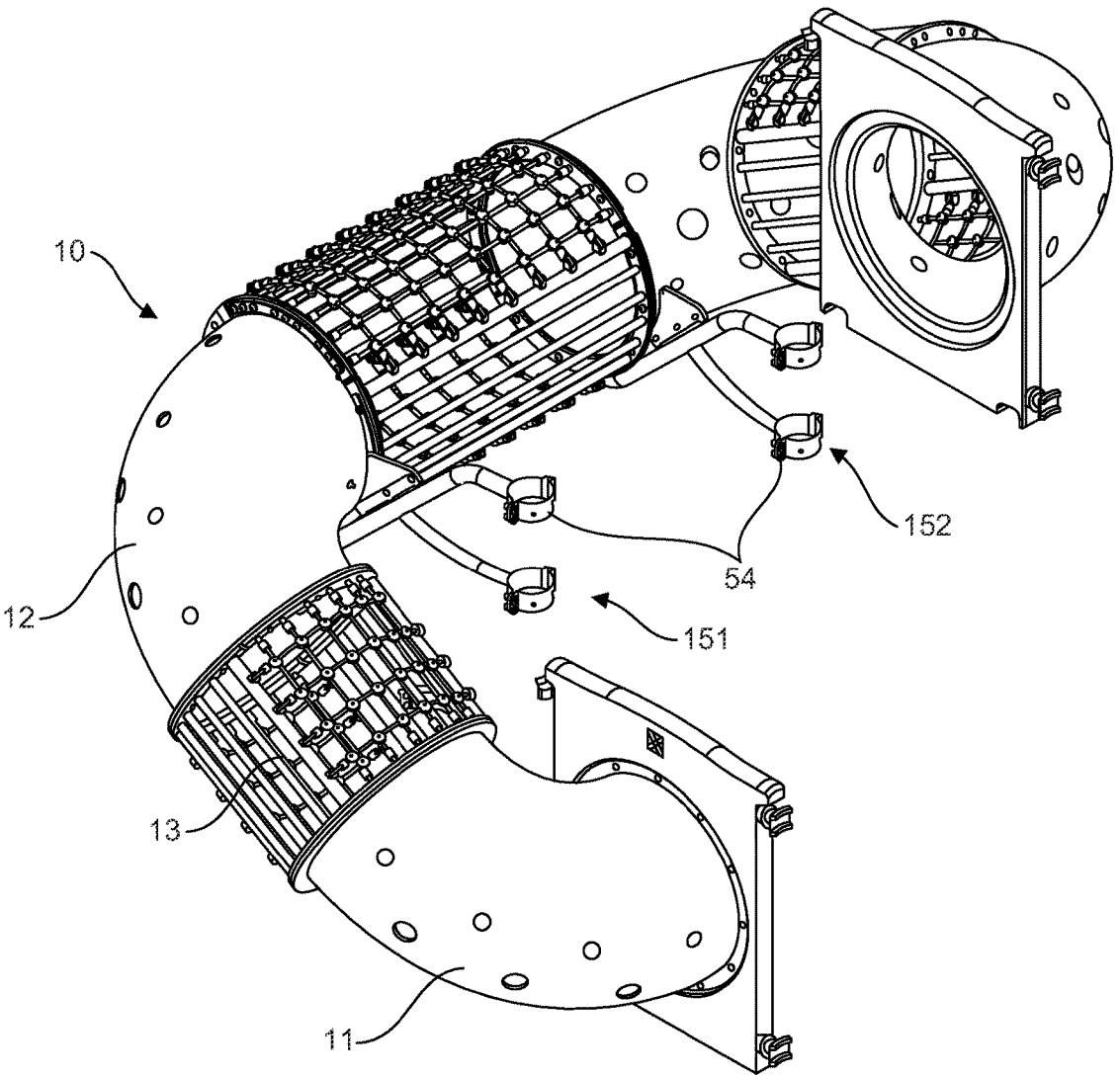
FIG. 12 is a left side perspective view of the climber unit of FIG. 11.
Figure 13:
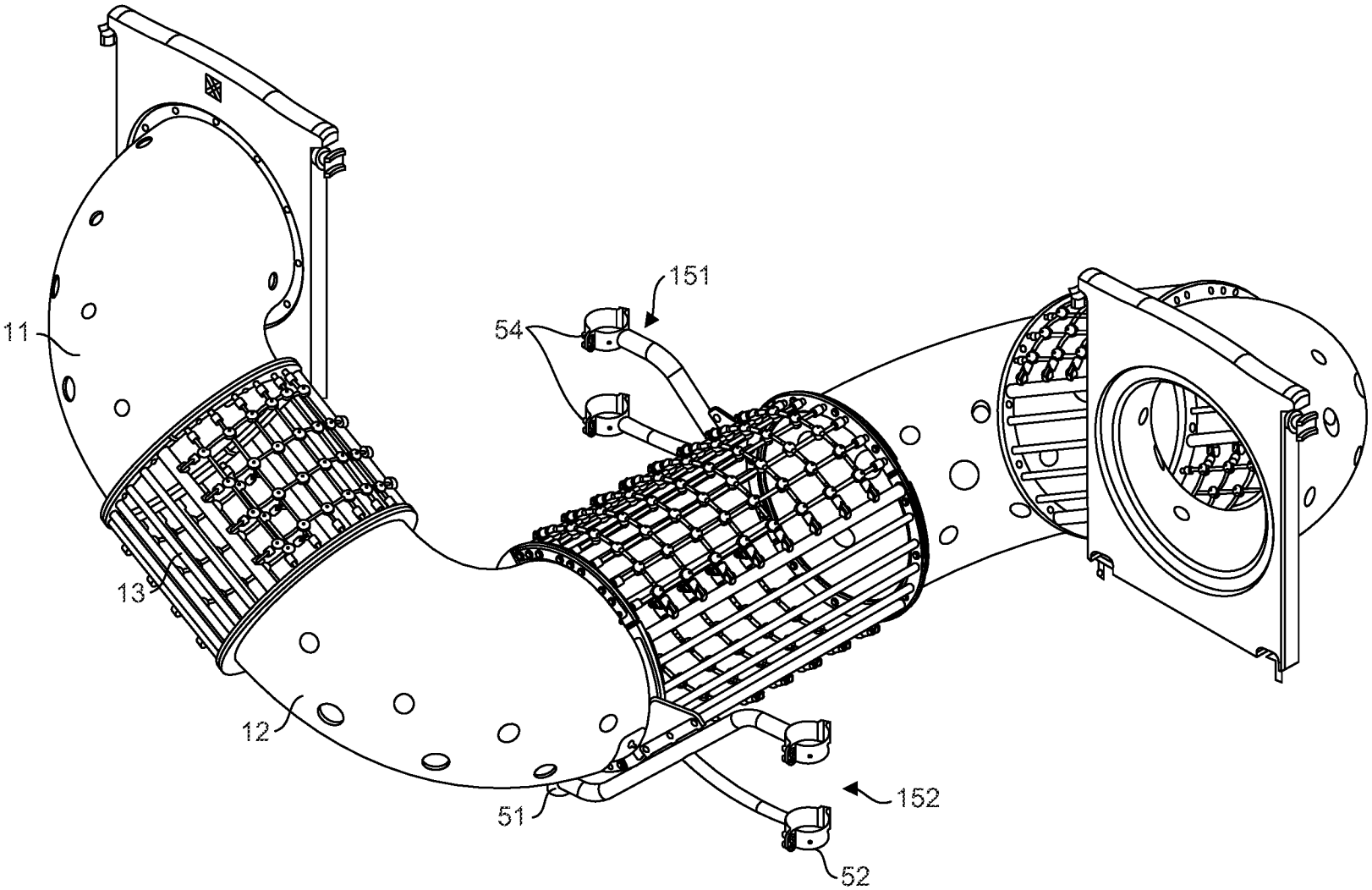
FIG. 13 is a perspective view of a climber unit according to an embodiment of the present disclosure.
Figure 14:
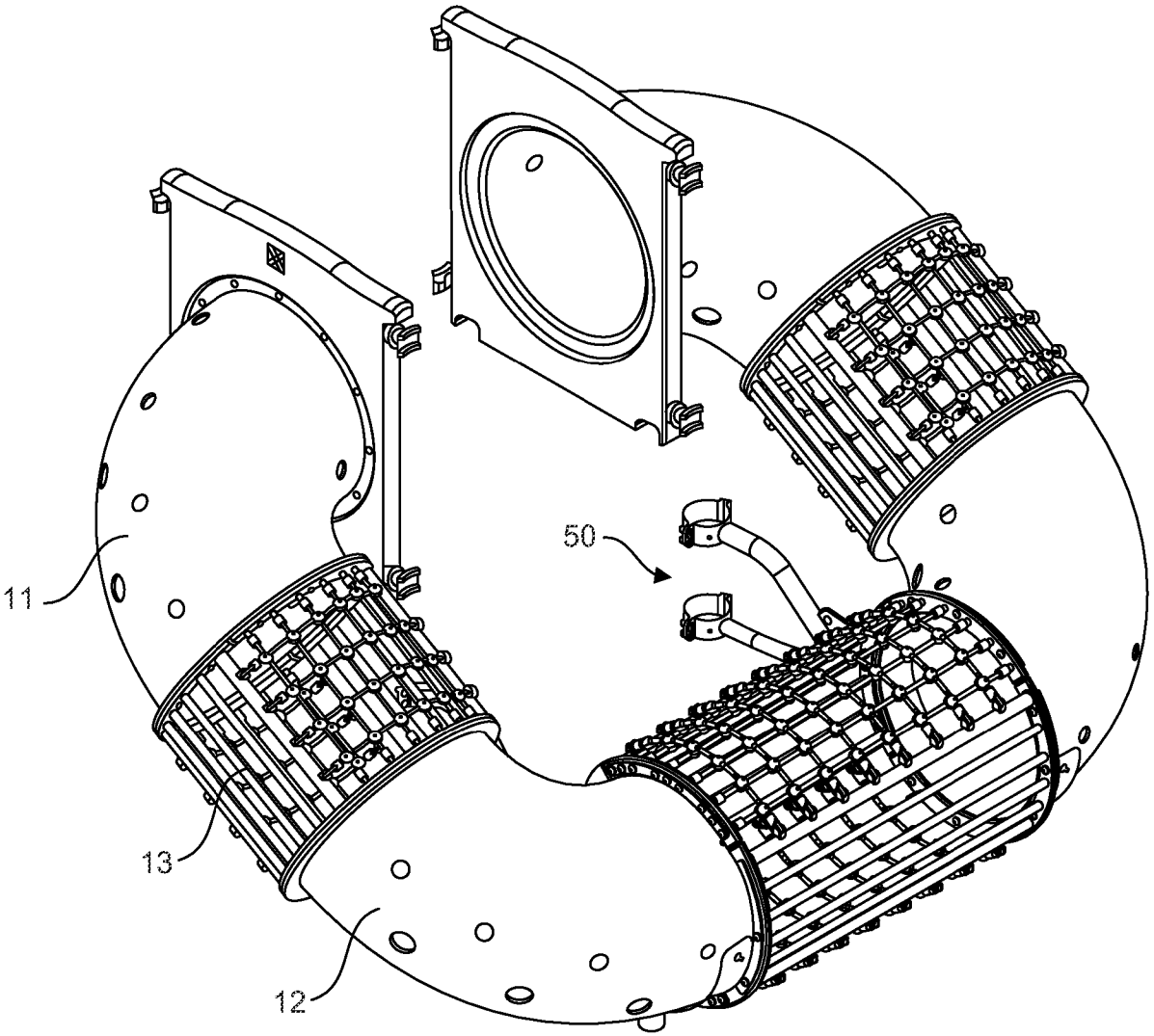
FIG. 14 is a perspective view of a climber unit according to an embodiment of the present disclosure.

The longitudinal cords 41 may be attached at each end to a retaining ring 43. Using threaded fasteners or the like, the retaining ring 43 may be affixed to the flange 16 of an adjacent tube section 31, 32, to the flange provided on a wall of an elevated play structure 100, or to an entry flange 35. In the illustrated embodiment, the cords 41 are secured to the retaining rings 43 by the relationship between cord heads 44 and notches 45 in the retaining rings. Namely, each longitudinal cord 41 may comprise a head element 44 having a dimension that is greater than that of notches 45 positioned around the retaining ring 43. Accordingly, then head element 44 of each cord 41 may be hooked over the notch 45 such that the bottom surface of head element 44 rests against the retaining ring and is too large to be pulled through the notch 45. This is shown, for example, in FIGS. 10A and 10B. A variety of other connection methods, however, may also be used to attach the longitudinal cords 41 to the retaining rings 43 without departing from the scope of the present disclosure.

In another aspect of the present disclosure, the climber units 10 may be mounted to an elevated playground structure 100 in a manner that either reduces the number of footers 33 used to support the climber unit 10 or eliminates the need for such footers entirely.

For instance, the climber unit 10 shown in FIG. 7 and the upper climber unit shown in FIG. 6 are supported by one or more trusses 37 that are attached to the elevated play structure 100 and that serve to support a portion of the weight of the climber unit. More particularly, the trusses 37 serve to distribute the weight of elevated sections of the climber unit 10 back to the support posts 101 of the elevated playground structure 100. By using trusses 37 in this manner, one or more footers 33 which typically serve to support a climber unit 10 via attachment to the ground, may be removed. Compare, for example, the embodiment shown in FIG. 7 with those shown in FIGS. 8-9.

The removal of one or more footers 33 is a significant achievement, as it opens up the space underneath the climber unit 10, thereby increasing the overall play space by removing obstacles to play. Notably, overhead trusses 37 such as those shown in FIGS. 6 and 7 may be used to suspend any of the various climber units 10 described herein, as well as other playground elements, such as slides (e.g. the slide shown on the right in FIG. 6).

The trusses 37 may be connected to the play unit—e.g. a climber unit 10 or slide—by any of a number of different manners. In the embodiment shown in FIG. 6 for example, the truss 37 may run above the climber unit 10 and may be attached to climber unit at defined locations. In the illustrated embodiment, for instance, the truss 37 may be attached to the climber unit 10 at the flanges between adjacent elevated portions. The truss may be connected to these flanges in any number of ways, such as by a connector element 38 that is bolted between the adjacent flanges, to an outer section of one (or both) of the adjacent flanges, etc. As shown in FIG. 6, the connector element 38 may span around a portion of the flange. The connector element 38 may be attached to the truss 37 via one or more support members 39. The support members 39 may be rigid (e.g. piping) or flexible (e.g. cables). In this way, elevated sections of the climber unit 10 may be suspended or cantilevered from the overhead truss 37.

Where the one or more trusses 37 are particularly long (i.e. are used to support a long climber unit 10, slide, or the like), the one or more trusses 37 may themselves be supported from the elevated playground structure 100 by one or more support members 47. Support members 47 may be rigid or, as shown in FIG. 6, flexible.

The one or more trusses 37 may span from a first level of the elevated playground structure 100 to a second level of the elevated playground structure, such as is shown in FIG. 6. In other embodiments, such as that shown in FIG. 7, the one or more trusses 37 may span from a first level of the elevated playground structure 100 to the vicinity of the play surface at the lower end of the climber unit 10. The climber unit 10 shown in FIG. 7, for example, comprises two trusses 37 that span from a first level of an elevated playground structure 100 to a support element 46 mounted around the lower opening of the climber unit. Support element 46 may, in turn, be connected directly to the play surface, such as through a small footer 33 or the like.

In contrast to that shown in FIG. 6, where the climber unit 10 (or slide, etc.) is relatively short, such as that shown in FIG. 7, the one or more trusses 37 may not need to be attached to the climber unit at various points along its length. Instead, the one or more trusses 37 may be attached only to the lower end of the climber unit 10, such as through support element 46 or the like.

The one or more trusses 37 may be connected directly to the support posts 101 of the elevated playground structure 100, as shown in FIG. 7, or to an additional structure, e.g. a crossbeam, that is attached to the support posts 101, as shown in FIG. 6. Other embodiments of the overhead trusses disclosed herein are also contemplated without departing from the scope of the present invention, so long as they operate to reduce or eliminate footers 33 that break up the flow of free play in the vicinity of an elevated playground structure 100.

In further embodiments, the climber units 10 may be mounted to an elevated playground structure 100 through one or more distinct coupling units 50. The coupling units 50 serve the same function as the trusses 37 described herein. However, the coupling units 50 may provide a number of advantages over trusses, such as ease of installation, overall aesthetic effect, etc.

Figure 16:
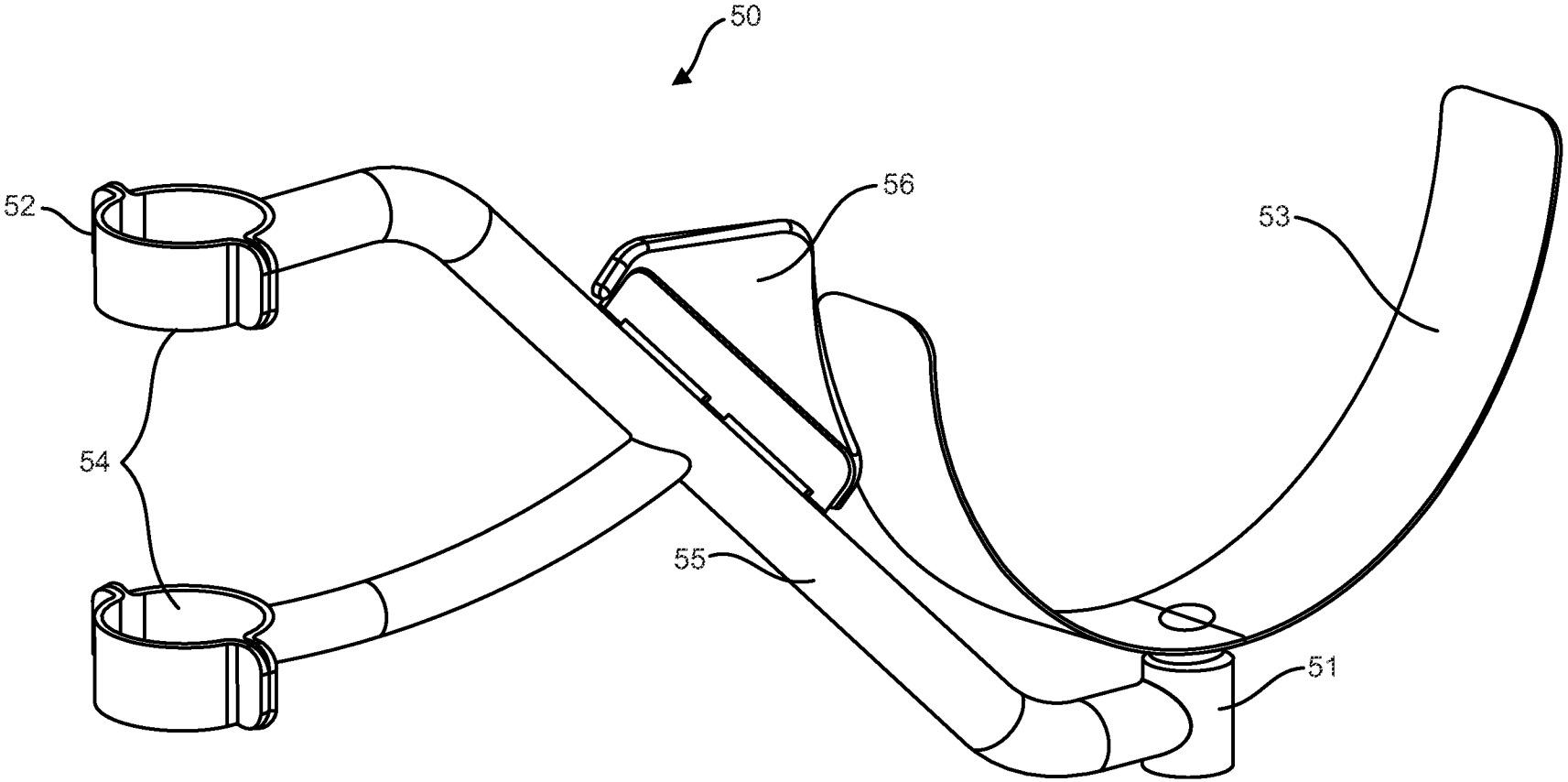
FIG. 16 is a perspective view of an embodiment of a coupling unit configured to mount a play unit (e.g. a climber, slide, etc.) to a support post of an elevated playground structure.

Each of the climber units 10 shown in FIGS. 11-14 comprise one or more coupling units 50. Moreover, an embodiment of a coupling unit 50 having a particular design is shown in FIG. 16. The coupling units 50 are each configured to span between a first end 51 and a second end 52. The first end 51 of the coupling unit 50 is configured to attach to the play unit, e.g. climber unit, slide, etc. The second end 52 of the coupling unit 50 is configured to attach to the elevated playground structure 100, and desirably directly to a support post 101 of the elevated playground structure.

In the illustrated embodiments, the first end 51 of the coupling unit 50 is configured to be attached to the underside of a portion of the play unit (hereinafter referred to as the climber unit 10 for simplicity, although it should be recognized that the play unit may also be a slide or other such play unit). For instance, the first end 51 of the coupling unit 50 may comprise a substantially U-shaped frame 53, which is configured for attachment to the underside of the climber unit 10. U-shaped frame 53 may be attached to the underside of the climber unit 10 in any number of ways, as would generally be understood by one of skill in the art. For instance, U-shaped frame 53 may comprise one or more apertures configured to receive conventional fasteners, e.g. bolts. In other embodiments, U-shaped frame 53 may comprise a flexible material which may be friction-fit onto the underside of the climber unit 10.

In the illustrated embodiments, the first end 51 of the coupling unit 50 may be attached to the climber unit 10 at a location adjacent flanges of connected portions of the unit. In other embodiments, however, the first end 51 of the coupling unit 50 may be attached anywhere along the length of the climber unit 10. Moreover, in some (non-illustrated) embodiments, the first end 51 of the coupling unit 50 may be configured to be attached to a flange, or flanges, of connected portions of the unit. For instance, the frame 53 may be configured to attach to an outer surface or surfaces of the flange(s) or may be configured to be positioned between the flanges (e.g. sandwiched) prior to their connection to one another.

In the illustrated embodiments, the second end 52 of the coupling unit 50 is configured to attach directly to a support post 101 of an elevated playground structure. For instance, the second end 52 of the coupling unit 50 may comprise one or more clamps 54 that are secured to a support post 101. In the illustrated embodiments, the second end 52 of the coupling unit 50 comprises a pair of clamps 54, one positioned directly above the other. This has been found to provide improved structural stability over an embodiment consisting of a single clamp 54. In other, non-illustrated embodiments, the second end 52 of the coupling unit 50 may be configured to attach to a different component of an elevated playground structure 100, such as a crossbar, floor decking, etc. (which is itself attached to support posts 101).

The first end 51 and second end 52 of the coupling unit 50 are separated by framework 55. Framework 55 may take on any shape, as may be needed to support a given climber unit 10. The framework 55 shown in the illustrated embodiments, however, has been found generally compatible with a number of different climber unit 10 configurations.

In some embodiments, coupling unit 50 may also include one or more stability-enhancing elements 56. Stability-enhancing elements 56 may connect frame element 53 with a portion of the framework 55 so as to reduce or prevent rocking of the climber unit 10. Stability-enhancing elements 56 may also serve to prevent entrapment of one's fingers or the like between frame element 53 and framework 55. As with framework 55, stability-enhancing elements 56 may take on any desired configuration and are not limited to the particular design shown in FIG. 16.

The coupling units 50 may be positioned at intervals along the length of the climber unit 10, such as is dictated by the length and weight of the climber unit. For example, the climber unit 10 shown in FIGS. 11 and 12, which spans between opposing sides of an elevated playground structure 100 at different elevations, comprises a first coupling unit 151, which is configured to attach to a first support post 101 of the playground structure, and a second coupling unit 152, which is configured to attach to a second support post 101 of the playground structure (distinct from the first support post). Similarly, the climber unit 10 shown in FIG. 13, which spans between two elevated play structures 100, comprises a first coupling unit 151, which is configured to attach to a support post 101 of the first playground structure, and a second coupling unit 152, which is configured to attach to a support posts 101 of the second playground structure. In contrast, the climber unit 10 shown in FIG. 14, which spans between opposing sides of an elevated playground structure 100 at the same elevation, comprises a single coupling unit 50 that is configured to attach to a support post 101 of the elevated playground structure. A greater or fewer number of coupling units 50 may be utilized with any of the illustrated climbing units 10, as necessary to provide sufficient structural support.

It can be seen that the described embodiments provide unique and novel climber units 10 that have a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A playground structure comprising:

an elevated play structure;

a climber or slide extending from the elevated play structure; and one or more coupling units, each of the one or more coupling units spanning between the elevated play structure and a location along a length of the climber or slide;

wherein each of the one or more coupling units support at least a portion of a weight of the climber or slide;

wherein at least one of the one or more coupling units has a first end attached to the climber or slide and a second end attached to a support post of the elevated play structure, and wherein the first end comprises a substantially U-shaped frame that wraps around an underside of a portion of the climber or slide; and wherein the second end comprises a first clamp and a second clamp, the first clamp being positioned directly above the second clamp.

2. The playground structure of claim 1, wherein the one or more coupling units comprises a first coupling unit and a second coupling unit, the first coupling unit and the second coupling unit being spaced apart from one another along a length of the climber or slide.

3. The playground structure of claim 2, wherein the first coupling unit is attached to a first support post of the elevated play structure and the second coupling unit is attached to a second support post of the elevated play structure.

4. The playground structure of claim 1, wherein the first clamp and the second clamp are attached to a single support post of the elevated play structure.

5. The playground structure of claim 1, wherein the climber or slide comprises a plurality of components connected together, and wherein the first end of the at least one of the one or more coupling units is attached to the climber or slide at a position adjacent a flange of one of the plurality of components of the climber or slide.

6. The playground structure of claim 1, wherein the climber or slide comprises a plurality of components connected together, and wherein the first end of the at least one of the one or more coupling units is attached to a flange of one of the plurality of components of the climber or slide.

7. The playground structure of claim 1, wherein the at least one of the one or more coupling units comprises a piped framework extending between the first end and the second end.

8. The playground structure of claim 1, wherein the at least one of the one or more coupling units comprises a stability-enhancing element that reduces movement of the climber or slide.

9. The playground structure of claim 1, wherein the one or more coupling units reduce the number of footers that would otherwise span between the climber or slide and a ground surface.

10. The playground structure of claim 1, wherein the playground structure is free of footers spanning between the climber or slide and a ground surface.

11. The playground structure of claim 1, wherein the climber or slide is a climber having a first end attached to the elevated play structure and a second end attached to the elevated play structure.

12. A playground structure comprising:

an elevated play structure;

a climber or slide extending from the elevated play structure; and one or more coupling units, each of the one or more coupling units spanning between the elevated play structure and a location along a length of the climber or slide;

wherein each of the one or more coupling units support at least a portion of a weight of the climber or slide;

wherein at least one of the one or more coupling units has a first end attached to the climber or slide and a second end attached to the elevated play structure, and wherein the first end comprises a substantially U-shaped frame that wraps around an underside of a portion of the climber or slide;

wherein the at least one of the one or more coupling units comprises a stability-enhancing element that reduces movement of the climber or slide; and wherein the at least one of the one or more coupling units comprises a framework extending between the first end and the second end; and the stability-enhancing element spans between the substantially U-shaped frame and the framework.

13. The playground structure of claim 12, wherein the stability-enhancing element has a curved surface that aligns with a curved outer surface of the climber or slide.

14. A playground structure comprising:

an elevated play structure;

a climber or slide extending from the elevated play structure; and one or more coupling units, each of the one or more coupling units spanning between the elevated play structure and a location along a length of the climber or slide;

wherein each of the one or more coupling units support at least a portion of a weight of the climber or slide;

wherein at least one of the one or more coupling units has a first end attached to the climber or slide and a second end attached to the elevated play structure, and wherein the first end comprises a substantially U-shaped frame that wraps around an underside of a portion of the climber or slide;

wherein the at least one of the one or more coupling units further comprises a framework extending between the first end and the second end, the framework including at least (i) a main arm and (ii) a supplementary arm that extends from the main arm; and at least a first clamp and a second clamp at the second end, each of the first clamp and the second clamps being attached to a support post of the elevated play structure;

wherein the first clamp is positioned on the main arm and the second clamp is positioned on the supplementary arm.

15. The playground structure of claim 14, wherein the climber or slide comprises a plurality of components connected together, and wherein the first end of the at least one of the one or more coupling units is attached to the climber or slide at a position adjacent a flange of one of the plurality of components of the climber or slide.

16. The playground structure of claim 14, wherein the climber or slide comprises a plurality of components connected together, and wherein the first end of the at least one of the one or more coupling units is attached to a flange of one of the plurality of components of the climber or slide.

17. The playground structure of claim 14, wherein the framework extending between the first end and the second end is a piped framework.

18. The playground structure of claim 14, wherein the at least one of the one or more coupling units comprises a stability-enhancing element that reduces movement of the climber or slide.

19. The playground structure of claim 14, wherein the playground structure is free of footers spanning between the climber or slide and a ground surface.

20. The playground structure of claim 14, wherein the one or more coupling units comprises a first coupling unit and a second coupling unit, the first coupling unit and the second coupling unit being spaced apart from one another along a length of the climber or slide.

21. The playground structure of claim 14, wherein the climber or slide is a climber having a first end attached to the elevated play structure and a second end attached to the elevated play structure.

* * * * *